United States Patent [19]

Fujitaki

[11] 4,163,375

[45] Aug. 7, 1979

[54] RIGHT ANGLE LOCK

[75] Inventor: Roy K. Fujitaki, Altadena, Calif.

[73] Assignee: VSI Corporation, Pasadena, Calif.

[21] Appl. No.: 869,549

[22] Filed: Jan. 16, 1978

[51] Int. Cl.[2] ..... E05B 65/06; E05C 1/06

[52] U.S. Cl. ..... 70/134; 70/360; 70/DIG. 80; 292/142

[58] Field of Search ..... 70/134, 190, 191, 360, 70/DIG. 79, DIG. 80; 292/142, 160, 172, 279

[56] References Cited

U.S. PATENT DOCUMENTS

| | | | |
|---|---|---|---|
| 359,183 | 3/1887 | Sherwood | 70/DIG. 80 |
| 788,515 | 5/1905 | Carlson | 292/172 |
| 3,561,805 | 2/1971 | Shaw | 292/172 |
| 4,009,599 | 3/1977 | Patriquin | 70/360 |

*Primary Examiner*—Robert L. Wolfe

[57] ABSTRACT

A lock has a bolt and a key-operated barrel at right angles, and with their axes coplanar. A pinion has teeth which engage teeth on the bolt and teeth on an extension of the barrel. The pinion, bolt and barrel are in a longitudinally split housing, held together by screws, the pinion having a slot to receive one of the screws. The barrel lock moves a latch plate transverse to its axes, so as to extend into a slot in the housing to prevent movement of the barrel.

25 Claims, 5 Drawing Figures

RIGHT ANGLE LOCK

BACKGROUND OF THE INVENTION

The present invention relates to locks, wherein a key-operated barrel causes movement of a latch.

There have been provided in the prior art a number of locks which include an operating member with a rack, and guided for linear movement, a pinion which is in mesh with the rack of the actuating member, and a bolt having teeth which are also in mesh with the pinion, so that rectilinear movement of the operating member causes rotation of the pinion, which in turn causes rectilinear movement of the bolt. In a number of these disclosures, the actuating member and the bolt were at substantially right angles to each other.

Shaw U.S. Pat. No. 3,561,805 discloses a lock of the above type, having a key-operated barrel which is spring urged to the outer position. An eccentric peg extends axially from the barrel, and may be moved, upon rotation of the barrel, between positions in which it is in line or out of line with an actuating rack which is guided for linear movement. The rack is in mesh with a pinion, intermediate the ends thereof, and adjacent each end of the pinion is a gear. These gears are in mesh with a pair of spaced racks which extend from the bolt, and cause movement of it, the racks of the bolt being at right angles to the rack of the actuating member. In this construction, the racks of the actuating member and of the bolt lie in spaced apart, parallel planes, thereby resulting in a relatively thick construction. The housing is not adapted to a sandwich construction of relatively thin form, to encompass the internal mechanism of the lock, and in the construction provided, it is possible to damage the lock by pushing the key-operated barrel inwardly, and then rotating it, so as to strike an actuating screw which extends from the actuating rack on the side, rather than axially on the end, as intended.

Brinson U.S. Pat. No. 2,431,105 provides a lock construction which includes a pair of handles, in side by side relationship, one on one side of a door and the other on the other side. These handles are movable in parallel planes, and each has an extension with a rack, the racks being in mesh with a pinion. A bolt is provided, having a rack also in mesh with the pinion, the bolt lying in a plane between the planes of the racks of the handles. There is thereby provided a relatively thick lock, which is not key-operated, and which is not capable of utilizing a formed sandwich type housing construction. The handles are spring urged, and are thereby subject to failure if the spring breaks.

Blixt et al U.S. Pat. No. 1,251,467 discloses a lock having an actuating member in the form of a rack, a pair of pinions which are in mesh with the actuating rack at spaced points therealong, and a pair of bolts with racks, one in mesh with each of the pinions, the bolts being in a single plane which is spaced from and parallel to the plane of the actuating member, thereby providing a relatively thick construction. The housing provided is not and apparently can not be of a formed, thin construction.

Van Wetzinga et al U.S. Pat. No. 1,195,881 further discloses a lock in which an actuating member has a rack in engagement with a pinion, and the pinion is carried on a shaft, there being a further pair of pinions on either side of the central pinion. A bolt is provided having a forked end, each part of which is provided with a rack which is in mesh with one of the spaced apart pinions. Thus, the construction provided is relatively thick, and is not amenable to a thin, formed, sandwich type housing. Also, this latch is not key-operated.

SUMMARY OF THE INVENTION

The present lock construction includes a housing which is longitudinally split, and is formed so as to provide by mating, semi-cylindrical guide surfaces, guides for a cylindrical bolt and for a cylindrical key-operated barrel, the longitudinally split housing also providing mounting for a pinion gear and a slot for receiving a latch. The barrel assembly includes a toothed extension, and the bolt has peripheral teeth, the axes of the barrel assembly and the bolt intersecting, being coplanar and at right angles. A pinion is mounted within the housing, and has teeth in mesh with the extension of the barrel assembly and with the teeth of the bolt, so that axial movement of the barrel assembly causes extension and retraction of the bolt. The pinion has spaced toothed portions, and a fastener for holding the lock in assembled relationship passes in the space between the two portions of the pinion. The barrel assembly comprises a key-operated barrel lock, and a generally cylindrical retainer for said barrel lock having a cylindrical portion which rotatably receives the barrel lock, the retainer having extending from it the aforementioned toothed, axial extension. A latch is provided in the barrel assembly, and is movable transversely of the barrel assembly upon rotation of the barrel lock, between a retracted position in which it is wholly within the perimeter of the retainer and an extended position in which a portion of the latch projects outwardly beyond the perimeter of the retainer, and into the aforementioned slot in the housing. The latch is moved by a pin which extends from the barrel lock, and which is engaged in a recess in the latch; track-like guides are provided on the barrel assembly and the latch, so as to guide the latch in its extending and retracting movements.

Among the objects of the present invention are to provide a lock which has a barrel assembly and a bolt positioned in coplanar, right angular relationship, so as to provide a relatively thin construction. Another object is to provide a relatively thin lock construction of the aforesaid type, which is adapted to have a readily formed, longitudinally split housing. Yet another object is to provide a lock which can not be damaged inadvertently by a person having a key, nor be readily damaged through maliciousness. A further object is to provide such a lock which will be long lasting, avoiding the use of springs.

Other objects and many of the attendant advantages of the herein disclosed invention will be readily understood from the following specification, taken in conjunction with the appended drawings.

DESCRIPTION OF THE PREFERRED EMBODIMENT

Figure 2:
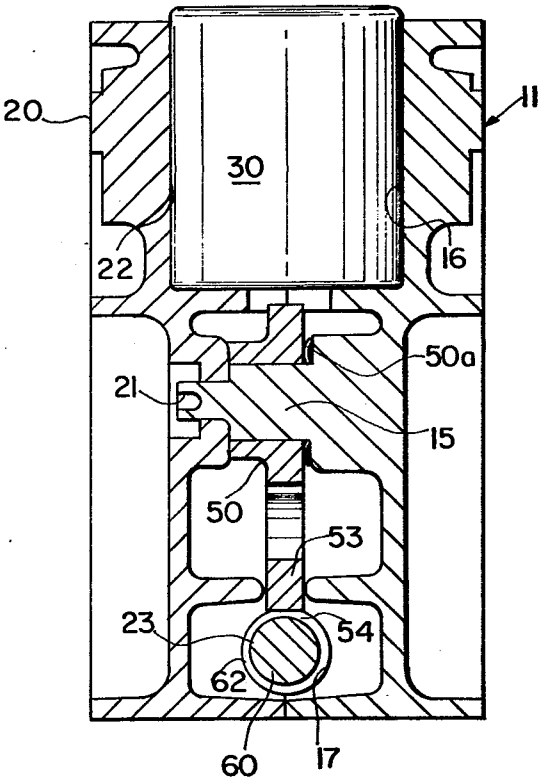
FIG. 2 is a cross sectional view taken on the line 2—2 of FIG. 1.
Figure 3:
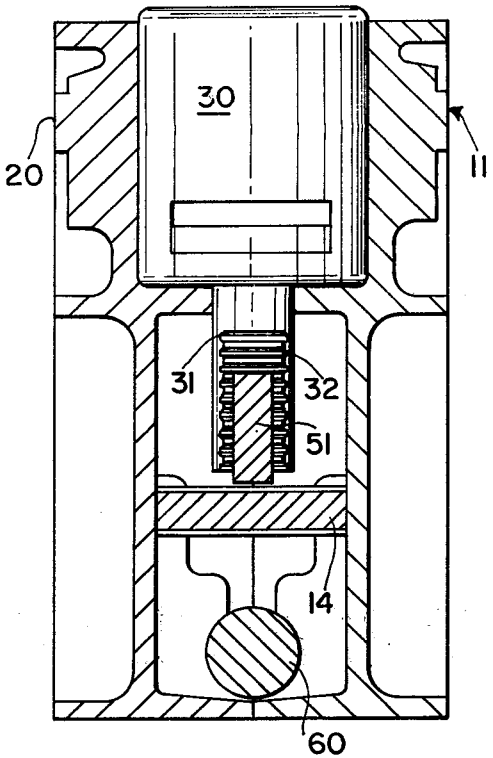
FIG. 3 is a cross sectional view taken on the line 3—3 of FIG. 1.
Figure 1:
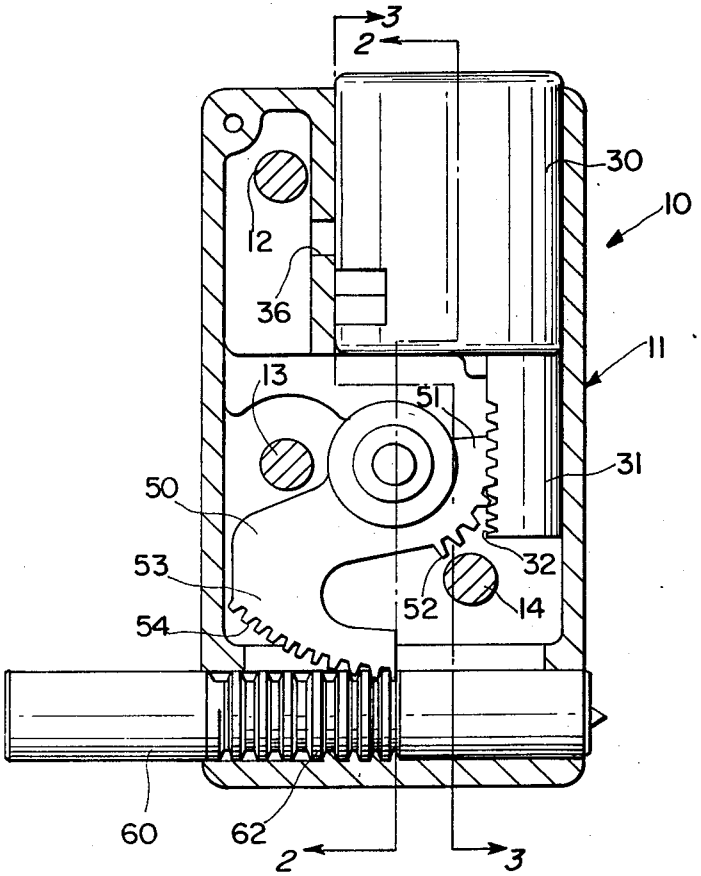
FIG. 1 is an elevational view, with a housing part removed, of a lock in accordance with the present invention.

Referring now to the drawings, wherein like or corresponding reference numerals are used for like or corresponding parts throughout the several views, there is shown in FIG. 1 a right angle door lock generally designated 10, and including a housing part 11, which is formed to provide various guide and support surfaces as will be hereinafter set forth. As shown in FIGS. 2 and 3, there is provided a mating housing part 20. Referring again to FIG. 1, located in housing part 11 is a barrel assembly 30, a pinion 50, and a bolt 60. The barrel assembly 30 comprises an extension 31 having a rack 32 thereon, the teeth of which are in mesh with the teeth 52 of a first toothed portion 51 of the pinion 50. The second toothed portion 53 of the pinion 50 is spaced from the first portion 51, and has teeth 54 which are in mesh with teeth 62 on the bolt 60.

The housing part 11, and the mating housing part 20, are provided with transverse openings to receive transverse fastening elements, so as to hold the lock in assembled relationship. In FIG. 1, there may be seen fasteners 12, 13 and 14; due to the spacing of the portions 51 and 53 of the pinion 50, the fastener 14 will occupy the space between these portions when the barrel assembly 30 is moved upwardly, thereby rotating the pinion 50 and withdrawing the bolt 60. This construction provides for a compact, relatively thin lock 10.

Referring now to FIG. 2, housing part 11 may be seen to include an integral, molded pinion support post 15, which has the pinion 50 journalled thereon, and urged by spring washer 50*a*. The spring washer 50*a* creates friction on pinion 50, to prevent free rotation, and serves as a spring shim to permit commercial tolerances to be used and avoid secondary machining operations. The housing part 20 has an opening 21 to receive the end portion of pinion support post 15, the end of which may be flattened to provide for further securement of the housing parts 11 and 20 in assembled relationship. Housing parts 11 and 20 will be seen to have mating hollow cylindrical portions 16 and 22, for receiving in guiding relationship the barrel assembly 30. The second portion 53 of pinion 50 may be seen extending downwardly, the teeth 54 thereof being in mesh with the teeth forming the rack 62 of the bolt 60. Bolt 60 may be seen to be supported and guided in a pair of part-semi-cylindrical hollows 17 and 23 which are formed in the housing parts 11 and 20, respectively; as is apparent from FIGS. 1 and 2, the upper portion of the guiding support hollows for the bolt 60 formed in each of the housing parts 11 and 20 is relieved, so as to provide access to the rack 62 for the second portion 53 of pinion 50.

As shown in FIG. 3, the extension 31 has a rack 32 which is in mesh with the teeth 53 (not shown) of the first portion 51 of the pinion 50. The longitudinally split construction of the housing, made up of the housing parts 11 and 20, is readily seen, as is the coplanar relationship of the extension 31, pinion 50 and bolt 60.

Figure 5:
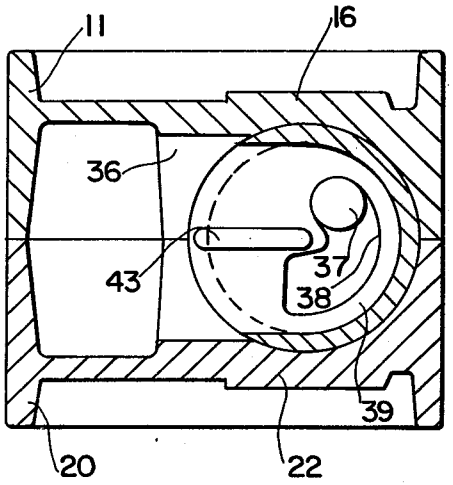
FIG. 5 is a cross sectional view taken on the line 5—5 of FIG. 4.
Figure 4:
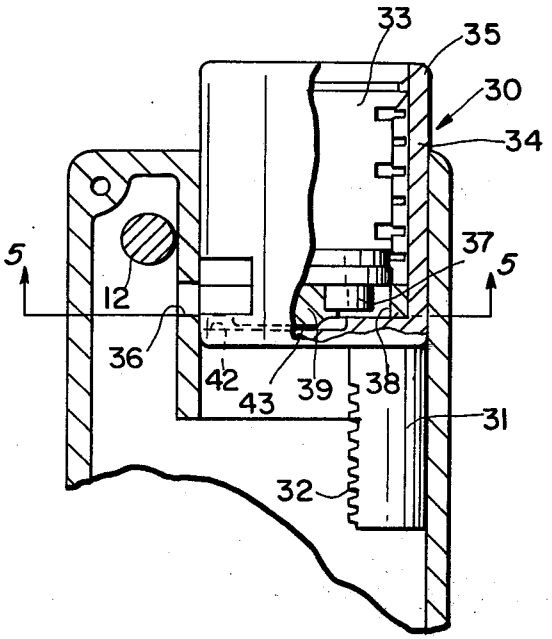
FIG. 4 is an elevational view, partly in section, showing the barrel assembly and latch forming a part of the present invention.

Referring now to FIGS. 4 and 5, the barrel assembly 30 may be seen, in FIG. 4 barrel assembly 30 including a conventional key-operated barrel lock 33 which is carried in a retainer 34 which comprises a cylindrical portion 35 which rotatably receives the key-operated barrel lock 33 therein. The retainer 34 in addition includes the aforementioned extension 31 with its rack 32. The barrel lock 33, while being rotatable in the cylindrical retainer portion 35, is not axially movable relative to it.

As best seen in FIG. 5, the cylindrical portion of the housing which is formed by the cylindrical hollow portions 16 and 22 is off-set in relation to the housing formed by the housing parts 11 and 20. These cylindrical hollow portions are provided with a slot 36, and the key-operated barrel lock 33 has an eccentric pin 37, which extends in the axial direction, into a recess 38 of generally arcuate shape which is formed in a plate 39 which functions as a latch. As seen in FIG. 4, the plate 39 rests on a shelf 41 which is transversely of the longitudinal axis of the barrel assembly 30, and is formed as a part of the retainer 34. The shelf 41 is provided with a longitudinally extending recess 42, which receives, in guiding relationship, an elongate protrusion 43 which extends downwardly, as shown in FIG. 4, from the bottom of the latch 39. Accordingly, in the FIG. 4 position, it will be understood that the key-operated lock 33 has been rotated, so as to move the pin 37 in an arcuate path, pin 37 engaging the walls of latch 39 forming the recess 38, thereby retracting latch 39 from the slot 36, the movement of latch 39 being in a direction transverse to the longitudinal axis of the key-operated lock 33 due to the guiding relationship of the protrusion 43 of latch 39 and the elongate recess 42 of the shelf 41. Once the latch 39 is in the retracted position, shown in FIG. 4, it is then possible to depress the entire barrel assembly 30, thereby moving the rack 32 in the axial direction, to thereby cause corresponding linear movement of the bolt 60.

In operation, referring first to FIG. 4, the key-operated barrel lock 33 has been rotated so as to withdraw the latch plate 39 from its locking position into its release position. Thereafter, the barrel assembly 30 may be depressed, to the position shown in FIGS. 1–3, so as to cause movement of the bolt 60 to the retracted position as shown therein, due to the rotation of pinion 50 by the linear movement of the extension 31, the pinion 50 causing linear movement of the bolt 60. Retraction or upward movement of the barrel assembly 30 is achieved with the key in the barrel lock 33, and rotated slightly so as to not be withdrawn therefrom. This rotation is permitted by the shape and size of the recess 38, which thereby permits some movement of the pin 37 without corresponding transverse movement of the latch plate 39. As will be understood, this linear movement of the barrel assembly 30 will cause rotation of pinion 50 and extension of bolt 60 into the locked position. Thereafter, the key-operated barrel lock 33 may be rotated further on its axis, so as to project the latch plate 39 outwardly, and into the slot 36, to thereby achieve locking of barrel assembly 30 against linear movement.

There has been provided a lock construction in which the housing is formed of a pair of housing parts which encompass and have within them the operating mechanism of the lock, including a barrel assembly, a bolt and a pinion. The barrel assembly and the bolt are in coplanar, right angular relationship, so that there results a relatively thin lock construction. The herein disclosed lock is not subject to damage by inadvertent operation thereof by a person having a key, and the lock is relatively secure against damage in opening through maliciousness. The herein disclosed lock is of long lasting construction, and has no spring.

It will be obvious to those skilled in the art that various changes may be made without departing from the spirit of the invention, and therefore the invention is not limited to what is shown in the drawings and described in the specification but only as indicated in the appended claims.

I claim:

1. A right angle door lock comprising:
(a) a housing,
(b) a key-operated barrel assembly axially slidable in said housing;
(c) an axially slidable bolt in said housing;
(d) means mounting said barrel assembly and said bolt with their axes intersecting and coplanar, and
(e) means engaging said bolt and said barrel assembly for causing conjoint movement thereof, comprising a pinion coplanar with said barrel assembly and said bolt, said barrel assembly and said bolt comprising racks, said racks being substantially coplanar;
(f) whereby said lock may be of small thickness transverse to the plane of said axes.

2. The lock of claim 1, wherein said axes are at right angles.

3. The lock of claim 1, said pinion comprising spaced first and second arcuate toothed portions each meshing with a said rack.

4. The lock of claim 3, said housing comprising facing housing parts having semi-cylindrical recesses for receiving said barrel assembly and said bolt, elongate fastening means extending transversely through said housing for securing said housing parts together, at least one said fastening means passing through said space between said toothed portions of said pinion.

5. The lock of claim 1, said barrel assembly comprising a barrel lock, a retainer for said barrel lock comprising a cylindrical portion rotatably receiving said barrel lock therein, said retainer comprising an axial extension, and said rack of said barrel assembly comprising teeth on said extension.

6. The lock of claim 1, said barrel assembly comprising a barrel lock, a retainer for said barrel lock comprising a cylindrical portion rotatably receiving said barrel lock therein, a latch carried by said barrel assembly, means for moving said latch transversely of the axis of said barrel lock upon rotation of said barrel lock in said retainer, between a retracted position wholly within the perimeter of said retainer and an extended position in which said latch is at least partially outside the perimeter of said retainer, and a slot in said housing for receiving said latch in the extended position thereof.

7. The lock of claim 6, said means for moving said latch comprising an axially extending pin on said barrel lock and a recess in said latch receiving said pin.

8. The lock of claim 7, and guide means for said latch for guiding said latch between said extended and retracted positions.

9. The lock of claim 8, said guide means comprising a transverse shelf on said retainer, said latch engaging said shelf, and cooperating guide means on said latch and said shelf.

10. A right angle door lock comprising:
(a) a housing comprising a pair of facing housing parts;
(b) a barrel assembly axially slidable in said housing;
(c) said barrel assembly comprising a rack;
(d) an axially slidable bolt in said housing;
(e) said bolt comprising a rack;
(f) a pinion in said housing rotatable on its axis having a first toothed portion in mesh with one rack and having spaced from said first portion a second toothed portion in mesh with the other rack;
(g) fastening means for securing said housing parts together, spaced from said axis, extending transversely of the plane of said pinion and in the space between the portions of said pinion.

11. The lock of claim 10, said barrel assembly comprising an extension, said rack being on said extension, the axes of said extension and said bolt being at right angles.

12. The lock of claim 10, said pinion being coplanar with said barrel assembly extension and said bolt.

13. The lock of claim 10, said barrel assembly comprising a barrel lock, a retainer for said barrel lock comprising a cylindrical portion rotatably receiving said barrel lock therein, said retainer comprising an axial extension, and said rack of said barrel assembly comprising teeth on said extension.

14. The lock of claim 10, said barrel assembly comprising a barrel lock, a retainer for said barrel lock comprising a cylindrical portion rotatably receiving said barrel lock therein, a latch carried by said barrel assembly, means for moving said latch transversely of the axes of said barrel lock in said retainer between a retracted position wholly within the perimeter of said retainer and an extended position in which said latch is at least partially outside the perimeter of said retainer, and a slot in said housing for receiving said latch in the extended position thereof.

15. The lock of claim 14, said means for moving said latch comprising an axially extending pin on said barrel lock and a recess in said latch receiving said pin.

16. The lock of claim 15, and guide means for said latch for guiding said latch between said extended and retracted positions.

17. The lock of claim 16, said guide means comprising a transverse shelf on said retainer, said latch engaging said shelf, and cooperating guide means on said latch and said shelf.

18. A right angle door lock comprising:
(a) a housing,
(b) a barrel assembly axially slidable in said housing comprising:
(i) a barrel lock;
(ii) a retainer for said barrel lock comprising a cylindrical portion rotatably receiving said barrel lock therein;
(iii) a latch carried by said barrel assembly;
(iv) means for moving said latch transversely of the axis of said barrel lock upon rotation of said barrel lock in said retainer between a retracted position wholly within the perimeter of said retainer and an extended position in which said latch is at least partially outside the perimeter of said retainer;
(v) an extension, a rack on said extension;
(vi) a bolt having a rack thereon;
(vii) pinion means in mesh with said racks, the axes of said extension and said bolt being at right angles;
(c) a slot in said housing for receiving said latch in the extended portion thereof.

19. The lock of claim 18, said means for moving said latch comprising an axially extending pin on said barrel lock and a recess in said latch receiving said pin.

20. The lock of claim 18, and said guide means for said latch for guiding said latch between said extended and retracted positions.

21. The lock of claim 20, said guide means comprising a transverse shelf on said retainer, said latch engaging said shelf, and cooperating guide means on said latch and said shelf.

22. The lock of claim 18, and further comprising a pinion and a bolt coplanar with said barrel assembly, and said barrel assembly, and said bolt comprising racks.

23. The lock of claim 22, said pinion comprising spaced first and second arcuate toothed portions each meshing with a said rack.

24. A right angle door lock comprising:

(a) a housing, (b) a barrel assembly axially slidable in said housing comprising:

(i) a barrel lock;

(ii) a retainer for said barrel lock comprising a cylindrical portion rotatably receiving said barrel lock therein;

(iii) a latch carried by said barrel assembly;

(iv) means for moving said latch transversely of the axis of said barrel lock upon rotation of said barrel lock in said retainer between a retracted position wholly within the perimeter of said retainer and an extended position in which said latch is at least partially outside the perimeter of said retainer;

(c) a slot in said housing for receiving said latch in the extended portion thereof, (d) a pinion and a bolt coplanar with said barrel assembly, (e) said barrel assembly and said bolt comprising racks, and (f) said pinion comprising spaced first and second arcuate toothed portions each meshing with a said rack.

25. The lock of claim 24, said housing comprising facing housing parts having semi-cylindrical recesses for receiving said barrel assembly and said bolt, elongate fastening means extending transversely through said housing for securing said housing parts together, at least one said fastening means passing through said space between said toothed portions of said pinion.

* * * * *